United States Patent [19]

Yamamoto et al.

[11] Patent Number: 4,626,470

[45] Date of Patent: Dec. 2, 1986

[54] IMPREGNATED CATHODE

[75] Inventors: Shigehiko Yamamoto, Tokorozawa; Sadanori Taguchi, Tokyo; Toshiyuki Aida, Chofu, all of Japan

[73] Assignee: Hitachi, Ltd., Tokyo, Japan

[21] Appl. No.: 750,777

[22] Filed: Jul. 1, 1985

[30] Foreign Application Priority Data

Jun. 29, 1984 [JP] Japan ..... 59-133149

[51] Int. Cl.[4] ..... H01J 1/14

[52] U.S. Cl. ..... 428/336; 428/472; 428/701

[58] Field of Search ..... 428/336, 472, 701

[56] References Cited

U.S. PATENT DOCUMENTS 4,494,035 1/1985 Palluel et al. ..... 313/346 R 4,518,890 5/1985 Taguchi et al. ..... 313/346 R

*Primary Examiner*—John E. Kittle

*Assistant Examiner*—Patrick J. Ryan

*Attorney, Agent, or Firm*—Antonelli, Terry & Wands

[57] ABSTRACT

An impregnated cathode comprising a refractory porous body impregnated with an electron emissive material and having an electron emissive surface, and a thin film disposed on the electron emissive surface and composed of a refractory metal and one of Sc, scandium oxide and a mixture thereof. The thin film containing Sc or scandium oxide is generated on the body in subsequent to impregnation of the electron emissive material into the refractory porous body with the result that a mono-atomic layer composed of Ba, Sc and O is maintained on the electron emissive surface over a long period of use.

11 Claims, 2 Drawing Figures

IMPREGNATED CATHODE

BACKGROUND OF THE INVENTION

This invention relates to impregnated cathodes.

Impregnated cathodes hold out a successful prospect for their ability to maintain high electron emission for a long time. Apart from such favorable high electron emission, a problem of the impregnated cathodes in that these cathodes must operate at a relatively high temperature between about 1050° C. and about 1200° C. which could cause evaporation of an electron emissive material, namely Ba and could result in a reduction in the service life of a heater.

In order to solve the foregoing problem, an attempt has been made wherein an electron emissive surface is coated with a layer of a precious metal, such as Os. Although this attempt has successfully lowered the operation temperature by 150° C. and more, it has not found to be entirely effective due to mutual diffusion between the coating metal layer and the body material of the cathode, and more particularly due to oxidation of the Os coating layer.

Instead of the Os coating or the like metal coating, an impregnated cathode disclosed in Japanese Patent Laid-open Publication No. 58-154131 comprises a body of a sintered material composed of $Sc_2O_3$ or oxides including Sc, such as $(Al, Sc)_2O_3$ and a refractory metal, such as W, and an electron emissive material impregnated in the sintered body. This cathode has an ability to operate at a lower temperature operation than that of the Os coated cathode. This cathode, so called $Sc_2O_3$ mixed matrix body impregnated cathode, is characterized by an electron emissive surface coated with a mono-atomic layer of low work function elements, such as Ba, Sc and O. This layer is, however, defective in its service life because regeneration of the layer, which has been lost by some reasons, requires a long, high temperature heat treatment, and sometimes such regeneration becomes impossible.

SUMMARY OF THE INVENTION

It is therefore an object of the present invention to provide an impregnated cathode which is operative at a low temperature and is easy to supply and regenerate a low work function mono-atomic layer.

According to the invention, the foregoing and other objects are attained by providing an impregnated cathode which comprises a refractory porous body impregnated with an electron emissive material and having an electron emissive surface, and a thin film disposed on said electron emissive surface and composed of a refractory metal and one of Sc, a scandium oxide and a mixture thereof.

DETAILED DESCRIPTION OF THE PREFERRED EMBODIMENTS

Figure 1:
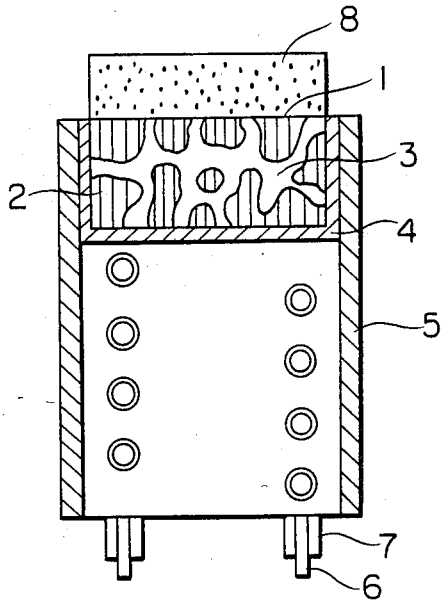
FIG. 1 is a schematic cross-sectional view showing an embodiment of an impregnated cathode according to the present invention.

A measurement on a surface analysis instrument has found that the cathode disclosed in Japanese Patent Laid-open Publication No. 58-154131 has, on its electron emissive surface, a mono-atomic layer which is composed of $Sc_2O_3$ or ScOx and Ba adsorbed thereon. This measurement indicates that in the construction of cathode structure, it is preferable to provide individual supply portions or passages for Ba and $Sc_2O_3$ with the Ba passages connected with each other.

To manufacture the impregnated cathode, an electron emissive material, such as barium aluminate is impregnated in pores in a refractory porous body made essentially of tungsten. The impregnation is carried out at a high temperature between 1700° C. and 1900° C. so as to melt barium aluminate. It is considered in this connection that if $Sc_2O_3$ is included in tungsten in the body, most parts of the electron emissive material will react on $Sc_2O_3$ at such elevated temperature and change in barium scandate ($Ba_3Sc_4O_9$) or the like. A mono-atomic layer of Ba, Sc and O formed on an electron emissive surface is composed of non-reacted parts of $Sc_2O_3$ or ScOx and Ba so that once such layer is lost due to an ion bombardment resulting from the discharge in a picture tube or a pickup tube in which the cathode is used, regeneration of the same layer will require a long time heat treatment at a high temperature. This is because the thus produced $Ba_3Sc_4O_9$ has a high binding energy and a low vapor pressure so that the decomposition reaction thereof and the migration of the decomposed material to a cathode surface require a process of high activation energy. It is therefore necessary to avoid production of $Ba_3Sc_4O_9$ in a generation process of the mono-atomic layer.

Accordingly, a cathode of the present invention is characterized in that a refractory porous body impregnated with an electron emissive material is manufactured in advance, and a thin film composed of a refractory metal and Sc and/or a scandium oxide is then formed on an electron emissive surface of the body.

For the refractory porous body, those materials which are used for conventional impregnated cathodes are also usable. Namely, W, Mo, Ir, Pt, Re or the like element or an alloy thereof can be used. The porosity of the body is between 12% and 50%, preferably between 15% and 35%, and more preferably between 20% and 25%. As known in the art, it is possible to add at least one of Zr, Hf, Ti, Cr, Mn, Al and Si to the refractory porous body as an activator.

The thin film preferably has a thickness between 10 nm and 1 μm. As the refractory metal for the thin film, it is used at least one metal selected from the group consisting of W, Mo, Ir, Os, Re and Pt. The quantity of Sc and/or $Sc_2O_3$ preferably is approximately between 1% by weight and 20% by weight, and more preferably between 5% by weight and 15% by weight. The insufficient quantity of Sc or $Sc_2O_3$ would lead to the difficulty of attaining a cathode which is operative at a low temperature. On the other hand, the excess $Sc_2O_3$ is undesirable since $Sc_2O_3$ is an insulator. The porosity of this film preferably is below 20% and more preferably below 10%. In the generation of the thin film, any suitable process may be used, however, in general, coating by vacuum sputtering, printing of a powder material, or coating as a sintered material is utilized.

An embodiment of the present invention is described below with reference to FIG. 1 in which an impregnated cathode of the invention is schematically shown in cross section. Numeral 1 denotes a pellet of a cathodes material having a diameter of 1.4 mm, the pellet 1 being composed of a porous tungsten (W) body 2 having a porosity between 20% and 25%, and pore 3. A porous body made of one of Mo, Ir, Pt, Re and an alloy thereof may be used instead of the W body. The pore 3 is filled or impregnated with an electron emissive material composed of $BaCO_3$, $CaCO_3$ and $Al_2O_3$ mixed together at a mole ratio of 4:1:1. Another electron emissive material having a different mole ratio or different component materials added thereto may be used. The pellet 1 is plugged in a tantalum (Ta) cup 4 which is laser-welded in turn to a tantalum (Ta) sleeve 5. Soldering may be used to join the Ta cup 4 and the Ta sleeve 5 instead of the laser-welding. A heater 7 having an alumina-coated tungsten (W) core wire 6 is used to heat the cathode. These structural elements or parts mentioned above constitutes a Ba supply source. The supply of Ba varies with the heating temperature, but it is also adjustable either by changing the mole ratio in the electron emissive material or by adding an activator, such as Zr, Hf, Ti, Cr, Mn, Si or Al to the body body material. A thin film 8 having a thickness of between 10 nm and 1 μm and composed of W and $Sc_2O_3$ is stuck on a surface of the pellet 1 by a vacuum radio frequency sputtering. As a substitute for W, one of Mo, Re, Pt, Ir, Ta and a alloy thereof may be used.

The cathode thus constructed was subjected to a measurement of the saturated current density while applying high voltage pulses having a width of 5 μS and a repetition rate of 100 Hz to an anode of the diode configuration. The result of this measurement is shown in FIG. 2.

Figure 2:
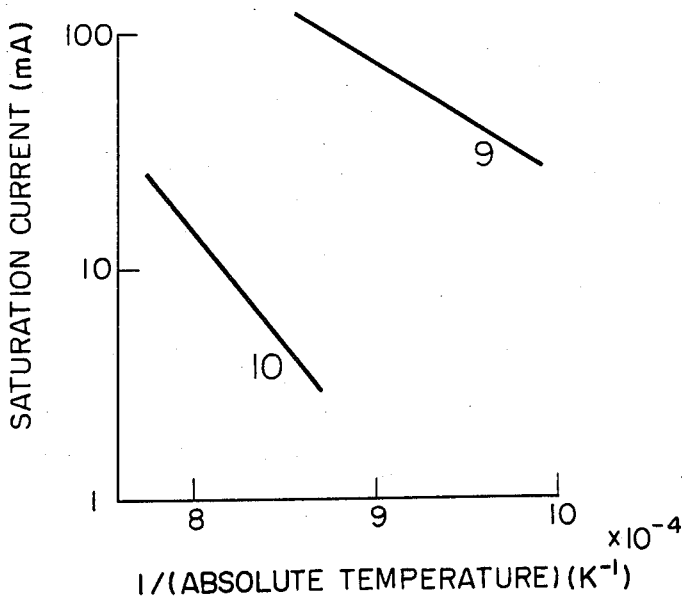
FIG. 2 is a graph illustrative of the electron emission property of the inventive cathode in comparison with that of a conventional impregnated cathode.

In FIG. 2, a line indicated by numeral 9 shows the electron emission property of the inventive cathode having a thin film coating composed of W and $Sc_2O_3$. A conventional $Sc_2O_3$ mixed matrix body impregnated cathode also showed the same property as the property 9 of the inventive cathode. However when the conventional cathode was subjected to an ion sputtering for 5 min which was carried out in an Ar environment at a pressure of about $5\times10^{-5}$ Torr while supplying emission current of 25 mA, a mono-atomic layer composed of Ba, Sc and O was removed. The electron emission property of the conventional cathode was reduced to such an extent as indicated by the line 10 in the same figure. On the contrary, the cathode of the invention did not show any reduction in the electron emission property due to the Ar ion sputtering.

The impregnated cathode of the invention is advantageous in that the mono-atomic layer composed of Ba, Sc and O, which has been lost by some reasons, can be regenerated by the component elements supplied during the operation of the cathode, thereby preventing a reduction in the electron emission property. Even if a reduction in this property occurs, a complete monoatomic layer will be formed by a heat treatment conducted at 1150° C. for 15–30 min. Thus, a long life, low temperature operation of the cathode is maintained.

What is claimed is:

1. An impregnated cathode comprising: a refractory porous body impregnated with an electron emissive material, free of Sc or scandium oxide, and having an electron emissive surface; and a thin film disposed on said electron emissive surface said film consisting essentially of a refractory metal and at least one of Sc and a scandium oxide.

2. An impregnated cathode according to claim 1, wherein said thin film has a thickness between 10 nm and 1 μm.

3. An impregnated cathode according to claim 1, wherein said thin film consists essentially of 1% by weight to 20% by weight of said at least one of Sc and said scandium oxide and 80% to 99% by weight of the refractory metal.

4. An impregnated cathode according to claim 3, wherein said refractory metal consists of at least one metal selected from the group consisting of W, Mo, Ir, Os, Re and Pt.

5. An impregnated cathode according to claim 1, wherein said refractory metal consists of at least one metal selected from the group consisting of W, Mo, Ir, Os, Re and Pt.

6. An impregnated cathode according to claim 5, wherein said refractory body is formed of W, Mo, Ir, Pt, Re or an alloy thereof.

7. An impregnated cathode according to claim 6, wherein said thin film consists essentially of 1% to 20% by weight of said at least one of Sc and scandium oxide and 80% to 99% by weight of the refractory metal.

8. An impregnated cathode according to claim 7, wherein the refractory body contains at least one activator selected from the group consisting of Zr, Hf, Ti, Cr, Mn, Al, and Si.

9. An impregnated cathode comprising: a refractory porous body that is impregnated with an electron emissive material, is free of Sc or scandium oxide, and has an electron emissive surface; and a thin film disposed on said electron emissive surface; said film having a thickness between 10 nm and 1 μm and consisting essentially of 80% to 99% by weight of a refractory metal and 1% to 20% by weight of at least one of Sc and a scandium oxide; and said refractory metal consisting of at least one metal selected from the group consisting of W, Mo, Ir, Os, Re and Pt.

10. An impregnated cathode according to claim 9, wherein said refractory body is formed of W, Mo, Ir, Pt, Re or an alloy thereof.

11. An impregnated cathode according to claim 10, wherein the refractory body contains at least one activator selected from the group consisting of Zr, Hf, Ti, Cr, Mn, Al, and Si.

* * * * *